United States Patent [19]

Kuo

[11] Patent Number: 4,673,948

[45] Date of Patent: Jun. 16, 1987

[54] FORESHORTENED DIPOLE ANTENNA WITH TRIANGULAR RADIATORS

[75] Inventor: Samuel C. Kuo, Saratoga, Calif.

[73] Assignee: GTE Government Systems Corporation, Mountain View, Calif.

[21] Appl. No.: 803,699

[22] Filed: Dec. 2, 1985

[51] Int. Cl.[4] ..... H01Q 11/10

[52] U.S. Cl. ..... 343/792.5; 343/807; 343/808

[58] Field of Search ..... 343/792.5, 794, 795, 343/807, 808, 811, 908

[56] References Cited

U.S. PATENT DOCUMENTS

| | | | |
|---|---|---|---|
| 3,213,457 | 10/1965 | Carr | 343/908 |
| 3,389,396 | 6/1967 | Minerva et al. | 343/792.5 |
| 3,573,839 | 4/1971 | Parker | 343/792.5 |
| 3,732,572 | 5/1973 | Kuo | 343/792.5 |
| 4,286,271 | 8/1981 | Barbano et al. | 343/792.5 |

FOREIGN PATENT DOCUMENTS

| | | | |
|---|---|---|---|
| 1221828 | 2/1971 | United Kingdom | 343/792.5 |

OTHER PUBLICATIONS

Kuo; "Size Reduced Log Periodic Dipole Array"; *1970 G-AP International Symposium;* pp. 151–158; 1970.

Kuo; "Size Reduced Log Periodic Dipole Array Antenna"; *Microwave Journal (GB)*; vol. 15, No. 12; pp. 27–33; 1972.

*Primary Examiner*—Robert E. Wise

*Attorney, Agent, or Firm*—John A. Odozynski

[57] ABSTRACT

A foreshortened log periodic antenna includes variously configured dipole elements which are arranged in four regions along the axis of the array. The first region includes a series of solid, triangular dipoles characterized by substantially constant base/height ratios. The second region similarly includes a series of solid, triangular dipoles. However, these elements are characterized by decreasing base/height ratios so as to afford a gradual transition into the third region, which includes a single linear dipole. The fourth region includes a series of solid or hollow rectangular elements connected by respective stems to the antenna feedline. In a manner set forth in U.S. Pat. No. 3,732,572, entitled "Log Periodic Antenna with Foreshortened Dipoles", the rectangular elements effect a reduction in the width of the array without a substantial affect on electrical performance.

25 Claims, 1 Drawing Figure

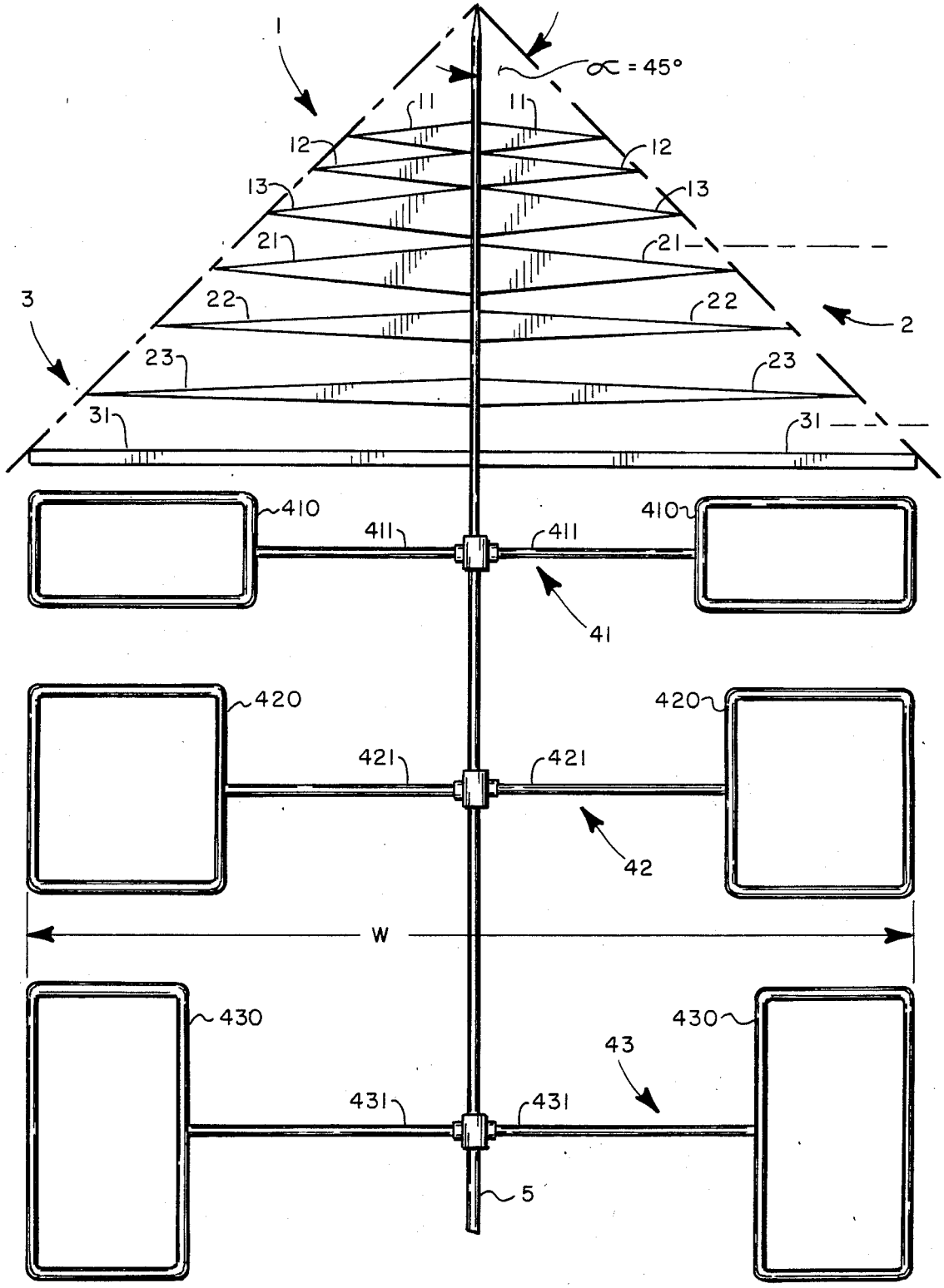
1
α = 45°
11
11
12
12
13
13
21
21
22
22
23
23
31
31
3
2
410
410
411
411
41
420
420
421
421
42
W
430
430
43
431
431
5

FORESHORTENED DIPOLE ANTENNA WITH TRIANGULAR RADIATORS

FIELD OF THE INVENTION

This invention relates to log periodic dipole antennas and, more particularly, to foreshortened log periodic dipole antennas comprising triangularly-configured elements.

BACKGROUND OF THE INVENTION

Because the log-periodic dipole antenna (hereinafter "LPDA") affords a theoretical infinite bandwidth, LPDAs are invariably proposed when applications demand broadband antennas. In practice, the frequency range within which an LPDA is able to operate is limited by the detail of the feed point and the length of the largest dipole, respectively. For a conventional LPDA, the length of the largest dipole is on the order of one-half the wavelength of the lowest operating frequency. This physical requirement precludes the use of LPDAs in some circumstances.

The conventional LPDA is defined primarily by two design parameters: Alpha, the enclosed angle, and Tau, the ratio of the distance between adjacent dipoles. Alpha controls the length of the antenna structure, and Tau determines the number of dipole elements. LPDAs with Alpha narrower than 15° and Tau greater than 0.9 generally provide high gain and directivity as well as nearly frequency-independent performance. In addition, for each Alpha there exists a correlatively optimal value of Tau. Deviation from the optimal value tends to result in a degradation in antenna performance. In practice, a lower Tau value is preferred because it requires less material and assembly time. However, for Alpha less than 15°, the LPDA will tolerate a relatively large range of Tau without significant performance degradation. For this reason, most size-reduction experiments have been conducted using LPDAs with relatively-small Alpha.

A number of design techniques for LPDAs with small Alphas have been demonstrated. An example is the reduced size antenna described in U.S. Pat. No. 3,543,277 entitled "Reduced Size Broadband Antenna" to Pullara. An antenna disclosed therein is characterized by an Alpha of 12° and a Tau of 0.95.

Various other efforts have been directed toward the reduction of the size of the LPDAs. (See, for example, Stephenson, "Log-Periodic Helical Dipole Array", *WESCON Digest* (1963); E. Young, "Foreshortened Log-Periodic Dipole Array", *WESCON Digest* (1963); Defonzo, "Reduced Size Log-Periodic Antennas", *Microwave Journal* (December, 1972)). Many resulting techniques were directed to capacitive "T" or "U" loading, or to replacing the linear dipoles with helical dipoles. However, such techniques have been able to achieve a reduction in the width of the LPDAs only at the expense of increased antenna boomlength. This is due to the fact that these types of dipoles exhibit higher Q than conventional dipoles. Consequently, an additional number of "foreshortened dipoles" need be added to the LPDA structure in order to preserve its frequency-independent or broadband characteristics. In addition, these techniques tend to increase the design complexity of the LPDA, primarily because foreshortening required more than the straightforward replacement of linear dipoles of an existing LPDA with reconfigured, foreshortened dipoles. As a result, the design of the foreshortened LPDA historically involved a large number of "cut and try" processes.

An improved technique subsequently discovered by the inventor of the instant invention and disclosed in U.S. Pat. No. 3,732,572 (hereinafter "'572") allows simple replacement, on a one-to-one basis, of the linear dipoles of a conventional LPDA with foreshortened counterparts. For further explication, see Kuo, "Size-Reduced Log-Periodic Dipole Array Antenna", *Microwave Journal* (December, 1972). This technique circumvents the experimental approach to foreshortened LPDA design. (The information contained in the '572 patent and the technical article authored by the inventor of the subject invention are hereby incorporated by reference as provided in Section 608.01(p) of the Manual of Patent Examining Procedure.)

The theoretical principle supporting the invention disclosed in '572 derives from the electromagnetic analogy that may be drawn between the rectangular waveguide and the slot antenna. As is well known, the cutoff wavelength of the fundamental mode of a rectangular waveguide is twice the width of the waveguide. Furthermore, the cutoff frequency of a ridged waveguide is known to be lower than that of a rectangular waveguide of identical width and height. Because the resonant frequency of a slot antenna is the analog of the waveguide resonant frequency, the antenna resonant frequency may be expected to correspond to the waveguide cutoff frequency. Specifically, the resonant frequency of a slot antenna may be expected to be reduced when its interior profile is formed in the fashion of the cross section of a ridged waveguide. Finally, because a dipole antenna is an analog, as defined by Babinets' principle, of the slot antenna, it is expected that the physical length of the dipole is susceptible of foreshortening when formed in the shape of a ridged waveguide. Empirical investigation has justified the above hypotheses. To wit: the invention embodied in '572 has permitted the physical size of a conventional dipole antenna to be foreshortened by as much as 35 to 40 per cent, without significant effect on its electrical characteristics. Foreshortening is accomplished by imparting to the dipole the interior cross-sectional profile of a ridged rectangular waveguide. However, even with access to the above technique, foreshortening of antennas with Alphas in excess of 45° is difficult to obtain. Heretofore, no known practitioner has successfully reduced the width of LPDAs with Alpha greater or equal to 45° at frequency higher than VHF range, 300 MHz.

The difficulty in foreshortening LPDAs with Alphas about 45° lies with the conventional LPDA itself. As a result, LPDAs with Alpha greater than 45° simply are not commercially available for microwave frequency range. To date, there has been only limited investigation of the performances and anomalies of LPDAs with large Alpha. (See, for example, Bantin, C. and Balmain, K., "Study of Compressed Log-Period Dipole Antennas", *IEEE Transaction on Antennas and Propagation* (March 1970)). The incentive to develop LPDA with large Alpha becomes apparent when it is understood that the boomlength of an LPDA with an Alpha of 45° is approximately one-fifth that of an LPDA with Alpha of 12°. Thus, while numerous efforts have been undertaken to reduce the width of the LPDAs with relatively small Alpha, very little effort has been devoted to the investigation of "short" LPDAs. In fact conventional LPDAs with large Alpha fail to retain their frequency independence unless special treatment is applied.

When the Alpha of an LPDA is increased, the optimized value of Tau is normally reduced in order to maintain proper spacing between the adjacent dipoles. By doing so, the number of near resonant dipoles is reduced in proportion to the reduction in Tau. When there are insufficient near-resonant dipoles in the active region to radiate a substantial portion of the excitation currents, the residue currents will propagate and excite the 1.5 L or even the 2.5 L dipoles. Radiation from these larger dipoles results in deterioration of the frequency independent characteristics of the LPDAs.

One method which will prevent the larger dipoles from radiating is to increase the feedline characteristic impedance by increasing the spacing of the two-wire balanced feedline. This approach forces a greater proportion of the energy from the feedline into the near resonant dipoles and therefore reduces the amount of the residue currents. As a result the LPDA typically assumes a mean input impedance of 140 ohms or more. A broadband impedance transformer is then required to transform the input impedance down to 50 ohms. This is very difficult to accomplish in microwave frequencies, especially when the maximum operating frequency approaches 20 GHz.

Another method involves the replacement of the linear dipoles with radiators with lower Q. The triangularly-shaped dipole is such a radiator. Its Q decreases as the base of the triangularly-shaped dipole increases. When the base dimension approaches zero, a linear dipole is obtained. These lower Q radiators will couple an enhanced proportion of energy from the feedline, with an effect identical to that obtained by introducing additional radiators into the active region. LDPAs with Alpha equal to 45° have been built and tested and no anomalies were observed. These results indicate that the largest proportion of the excitation currents are radiated by the near 0.5 L dipoles.

A disadvantage of the triangularly-shaped dipole is that it resonants at frequencies higher than a linear dipole of the same length. For a triangularly-shaped dipole which has a height to base ratio of 5:1, wherein "height" is defined as one-half of the dipole length, the triangular dipole must be approximately 20% longer than a linear dipole that resonants at the same frequency. Thus, an LPDA which has such triangularly-shaped dipoles must be 20% wider and longer than an LPDA with linear dipoles operating over the same frequency range. Clearly this is to be avoided inasmuch as the salient purpose of the triangularly-shaped dipole is to reduce the size of the antenna structure.

Consequently, what is desired is a heretofore unavailable LPDA configuration, for antennas with Alpha approaching 45°, that is amenable to "foreshortening" technique such as that disclosed in '572. An optimal configuration will circumvent the deterioration in broadband performance attendant heretofore known techniques. Preferably the chosen technique will not require a broadband impedance transformer such as is invoked by approaches involving increased spacing of the balanced feedline. Specifically, to the extent triangular radiating elements are employed, it will be necessary to devise an approach that mitigates the additional length triangular radiator must assume in order to resonate at the same frequencies as the linear dipole equivalent.

DISCLOSURE OF THE INVENTION

The above and other objects, advantages and capabilities are achieved in one aspect of the invention by an LPDA which is constrained to a maximum width, W. The antenna comprises a first group of triangular dipoles having monotonically varying heights but substantially mutually equivalent base-to-height ratios. The antenna further comprises a linear dipole having a length substantially equal to W. Interposed between the first group of triangular dipoles and the linear dipole is a second group of triangular dipoles characterized by respective base-to-height ratios that decrease in the direction from the first group of triangular dipoles to the linear dipole. In an optional embodiment, the LPDA includes a group of foreshortened dipoles, each comprising stem portions and generally rectangularly perimetered body portions configured so that the total length of each of the foreshortened dipoles is approximately equal to W.

BRIEF DESCRIPTION OF THE DRAWING

The drawing is a schematic plan view of the subject log periodic antenna with triangular radiators.

DESCRIPTION OF A PREFERRED EMBODIMENT

For a better understanding of the subject invention, reference is made to the following description and appended claims in conjunction with the above-described drawing.

Referring now to the drawing, depicted therein is a novel LPDA that comprises an arrangement of triangular dipoles, a single linear dipole, and, optionally as required, a series of foreshortened dipoles such as those disclosed in '572. The antenna may be viewed as being divided into four regions. Region 1 includes a group of solid triangular dipoles 11, 12, 13, of monotonically increasing height. Although dipoles 11, 12, and 13, because of their triangular configuration, necessarily have a physical length greater than the length required of their linear dipole equivalents, they present no compromise in the antenna construction inasmuch as their maximum length lies comfortably within the maximum allowable width, W, of the antenna. Dipoles 11, 12, and 13 are characterized by substantially mutually equivalent base-to-height ratios of 0.2.

Region 2 is a transition region that also includes a group of solid triangular dipoles, 21, 22, and 23, monotonically increasing height. However, in contradistinction to the triangular dipoles of region 1, the dipoles of region 2 exhibit a gradually decreasing base dimension and, therefore, a gradually decreasing base-to-height ratio. For example, for an LPDA operating in the 500 MHz to 20 GHz frequency range, the respective base-to-height ratios of dipoles 21, 22, and 23 assume the respective values of 0.16, 0.12, and 0.08. The dipoles of region 2 offer a smooth transition from the triangular radiators of region 1 to the single linear dipole 31 of region 3. The salient advantages offered by dipoles 21, 22, 23 derive from the fact that these dipoles are relatively low Q radiators and effect the requisite transformation from the high Q dipoles of region 1 into the single linear dipole. Because the dipoles of region 2 have roughly the same height as the linear dipole equivalents, the transformation from region 1 to the linear dipole of region 3 is brought about within the physical constraints imposed on the design of the antenna. Dipole 31 has a total length roughly equivalent to the maximum allowable width of the antenna.

An optional region 4 includes a group of foreshortened, or size-reduced dipoles 41, 42 and 43 having the configuration pellucidly set forth in '572. Each of the foreshortened dipoles includes a rectangularly perimetered body portion (410, 420, or 430) attached to feedline 5 through respective stems (411, 421, or 431).

Through utilization of the antenna design techniques disclosed herein, it has been possible to construct an LPDA, constrained to a maximum dimension of 6"×6", that provides frequency-independent performance within the aforementioned range of 500 MHz to 20 GHz. It is clear that, given the above description, an antenna designer possessing merely the skill of a routineer would be able to apply the subject invention to other frequency ranges as directed. Such application is clearly within the scope of this invention as contemplated by the appended claims.

In an alternative embodiment, performance at the lower operating frequencies is improved by varying the characteristic impedance of the two-wire feedline. When coaxial cables are used as the feedline, the characteristic impedance can be tailored by varying the spacing of the feedline along the antenna structure. For the case where the LPDA is etched on printed circuit boards and microstrip transmission lines are used as a feedline, the width of the microstrip may be tapered in order to vary the impedance.

The characteristic impedance of the feedline can thereby be kept low at the feed point in order to provide a better match to 50 ohms. The dipole elements near the feed point are low-Q, triangular dipoles, with relatively large base-to-height ratios. These elements will extract a substantial amount of excitation current from low impedance feedlines and therefore will circumvent the introduction heretofore encountered anomalies. The characteristic impedance of the feed line is increased toward the large end of the antenna structure where the linear dipole and the foreshortened dipoles, as well as some triangular dipoles with small base-to-height ratios, are located. These relatively high-Q dipole elements will also perform well as a result of their coupling to higher impedance feedlines. It should be noted that a broadband impedance transformer is not required for this configuration because the feedline itself becomes an impedance transformer. This is in contradistinction to feedlines which maintain a uniform high characteristic impedance throughout the entire length of the feedline and therefore require a broadband impedance transformer at the feed point.

It should be noted that the anomalous performance of LPDAs results from radiation by the 1.5 wavelength dipoles or arises when the active region (the location of the feedline where radiation takes place) is $\frac{1}{2}$ wavelength from the truncation of the large end. LPDAs with low-Q triangular dipoles are free from these anomalies. In the proposed configuration, with the LPDA Alpha near 45°, the largest dipole is never three times the length of any higher Q dipole on the same structure. Therefore, no 1.5 wavelength dipoles will ever be excited. Because the antenna is short with respect to the wavelength of the operating frequency, the active region of the higher-Q dipoles is always less than $\frac{1}{2}$ wavelength from the large truncation. For this reason, the proposed antenna will continue to provide satisfactory performance without to the alternate embodiment described, provided the large truncation is terminated into a resistor.

Accordingly, although there has been described herein what at present is deemed to be a preferred embodiment of an LPDA, it will be obvious to those having ordinary skill in the art that various changes and modifications may be made therein without departure from the scope of the invention as defined by the appended claims.

What is claimed is:

1. A log periodic antenna having a maximum width, W, and comprising:

a first group of triangular dipoles having substantially mutually equivalent base-to-height ratios, a linear dipole having a length substantially equal to W; and a second group of triangular dipoles interposed between the first group of triangular dipoles and the linear dipole and having respective base-to-height ratios that decrease in the direction from the first group of triangular dipoles to the linear dipole.

2. A log periodic antenna as defined in claim 1 for operation within the frequency range of approximately 500 MHz to 20 GHz and wherein the base-to-height ratios of the first group of triangular dipoles is approximately 0.19.

3. A log periodic antenna as defined in claim 1 for operation within the frequency range of approximately 500 MHz to 20 GHz wherein the base-to-height ratios of the second group of triangular dipoles varies from approximately 0.08 to 0.05.

4. A periodic log antenna as defined in claim 3 wherein the base-to-height ratio of the first group of triangular dipoles is approximately 0.19.

5. A log periodic antenna as defined in claim 1 further comprising a group of foreshortened dipoles, each comprising stem portions and a generally rectangularly perimetered body portions so configured that the total length of each of the foreshortened dipoles is approximately equal to W.

6. A log periodic antenna as defined in claim 5 wherein each of the foreshortened dipoles is characterized by a constant stem length, S, constant body length, A, and a variable body width, B, and wherein the ratio A/B respectively decreases with respect to foreshortened dipoles positioned increasing distances from the linear dipole.

7. A log periodic antenna as defined in claim 6 wherein the body portions of each of the dipoles is in the form of the interior cross section of a hollow rectangular waveguide.

8. As log periodic antenna as defined in claim 7 for operation within the frequency range of approximately 500 MHz to 20 GHz and wherein the base-to-height ratios of the first group of triangular dipoles is approximately 0.19.

9. A log periodic antenna as defined in claim 7 for operation within the frequency range of approximately 500 MHz to 20 GHz wherein the base-to-height ratios of the second group of triangular dipoles varies from approximately 0.008 to 0.05.

10. A periodic log antenna as defined in claim 9 wherein the base-to-height ratio of the first group of triangular dipoles is approximately 0.19.

11. A log periodic antenna as defined in claim 6 wherein the body portions of each of the dipoles are in the form of solid rectangular sheets.

12. A log periodic antenna as defined in claim 11 for operation within the frequency range of approximately 500 MHz to 20 GHz and wherein the base-to-height ratios of the first group of triangular dipoles is approximately 0.19.

13. A log periodic antenna as defined in claim 11 for operation within the frequency range of approximately 500 MHz to 20 GHz wherein the base-to-height ratios of the second group of triangular dipoles varies from approximately 0.08 to 0.05.

14. A periodic log antenna as defined in claim 13 wherein the base-to-height ratio of the first group of triangular dipoles is approximately 0.19.

15. A log periodic dipole antenna comprising a feed line to which is attached a plurality of dipole elements, the elements arranged in at least three regions along the length of the feedline, wherein the three regions include:

a first region comprising a series of triangular dipoles characterized by a substantially constant base/-height ratio;

a second, transition, region comprising a series of triangular dipoles characterized by a gradually decreasing base/height ratio; and a third region comprising at least one linear dipole.

16. A logic periodic dipole antenna as defined in claim 15 wherein the linear dipole assumes substantially the maximum allowable length permitted given the dimensional constraints imposed on the antenna.

17. A foreshortened log periodic antenna comprising a feedline to which are attached a plurality of dipole elements, the elements arranged in four regions along the length of the feedline so as to include:

a first region comprising a series of solid triangular dipoles characterized by substantially constant base/height ratios;

a second region comprising a series of solid triangular dipoles characterized by decreasing base/height ratios;

a third region comprising at least one linear dipole; and a fourth region comprising a series of foreshortened dipoles.

18. A log periodic antenna as defined in claim 17 wherein the dipole elements are arranged in four regions along the length of the feedline and the fourth, foreshortened, region is characterized by a series of dipoles connected by respective stems to the feedline, the dipoles themselves constructed in planar form with generally rectangular perimeters.

19. A log periodic antenna as defined in claim 18 wherein the linear dipole included in the third region has the maximum allowable length permitted by the dimensional constraints imposed upon the antenna.

20. A foreshortened log periodic antenna comprising a feedline to which are attached a plurality of dipole elements, the elements arranged in four regions along the length of the feedline so as to include:

a first region comprising a series of solid triangular dipoles characterized by substantially constant base/height ratios;

a second region comprising a series of solid triangular dipoles characterized by decreasing base/height ratios;

a third region comprising at least one linear dipole; and a fourth region comprising a series of foreshortened dipoles, each of the foreshortened dipoles comprising a generally rectangularly perimetered body portion attached through a stem portion to the feedline.

21. A foreshortened log periodic antenna as defined in claim 20 wherein the body portion of each of the foreshortened dipoles is in the form of a solid sheet.

22. A foreshortened log periodic antenna as defined in claim 20 wherein the body portion of each of the foreshortened dipoles assumes the form of a cross section of a hollow, ridged rectangular waveguide.

23. A foreshortened log periodic antenna as defined in claim 20 wherein the dipoles included in the first, second and third regions are all oriented to reside in the same virtual plane and wherein the foreshortened dipoles included in the fourth region are oriented to reside in plane orthogonal to said plane.

24. A foreshortened log periodic antenna as defined in claim 23 wherein the body portion of each of the foreshortened dipoles is in the form of a solid sheet.

25. A foreshortened log periodic antenna as defined in claim 23 wherein the dipoles included in the first, second and third regions are all oriented to reside in the same virtual plane and wherein the foreshortened dipoles included in the fourth region are oriented to reside in plane orthogonal to said plane.

* * * * *